US006732872B1

(12) United States Patent
Gregro et al.

(10) Patent No.: US 6,732,872 B1
(45) Date of Patent: May 11, 2004

(54) BABY NURSER WITH PLUNGER DEVICE

(76) Inventors: James H. Gregro, 200 W. Meadow Ave., Robesonia, PA (US) 19551; Wendy S. Gregro, 200 W. Meadow Ave., Robesonia, PA (US) 19551

( * ) Notice: Subject to any disclaimer, the term of this patent is extended or adjusted under 35 U.S.C. 154(b) by 0 days.

(21) Appl. No.: 10/242,884

(22) Filed: Sep. 13, 2002

(51) Int. Cl.[7] ..... A61J 9/00

(52) U.S. Cl. ..... 215/11.3; 215/11.1; 215/11.6; 222/95; 222/386

(58) Field of Search ..... 215/11.1–11.6; 248/102, 105; 222/95, 386

(56) References Cited

U.S. PATENT DOCUMENTS

| | | | | | |
|---|---|---|---|---|---|
| 3,162,318 | A | | 12/1964 | Woodbury | |
| 3,648,873 | A | | 3/1972 | Grobbel | |
| 4,176,754 | A | * | 12/1979 | Miller | 215/11.5 |
| 4,796,767 | A | * | 1/1989 | McKeown | 215/11.1 |
| 4,880,125 | A | | 11/1989 | LeBeau | |
| 4,979,629 | A | * | 12/1990 | Askerneese | 215/11.1 |
| 5,033,631 | A | * | 7/1991 | Nightingale | 215/11.1 |
| D331,111 | S | | 11/1992 | Mazza et al. | |
| D334,236 | S | * | 3/1993 | Turknett | D24/193 |
| D338,531 | S | * | 8/1993 | Howell | D24/193 |
| 5,301,825 | A | * | 4/1994 | Di Scala et al. | 215/11.1 |
| D352,785 | S | * | 11/1994 | Fitzgerald | D24/193 |
| D353,006 | S | * | 11/1994 | Korzenko | D24/193 |
| D365,150 | S | * | 12/1995 | Conklin | D24/193 |
| 5,524,783 | A | | 6/1996 | Popoff | |
| 5,660,359 | A | | 8/1997 | Lurie et al. | |
| 2002/0088827 | A1 | * | 7/2002 | Colucci | |

FOREIGN PATENT DOCUMENTS

| | | | | |
|---|---|---|---|---|
| CA | 1010424 A | * | 5/1977 | 215/11.3 |
| EP | 0009460 A1 | * | 4/1980 | 215/11.1 |

* cited by examiner

*Primary Examiner*—Sue A. Weaver

(57) ABSTRACT

A new baby nurser with plunger device for evenly expelling excess air for a nurser-style bottle. The inventive device includes a plunger portion that includes a circular base. The plunger portion includes a post extending upwardly from the circular base. The post has a flat upper free end. The post is dimensioned for being received within an open lower end of a shell of a baby nurser. A rubber dome is positioned within the open lower end of the shell below a liner therein. The rubber dome has an open lower end for receiving the flat upper free end of the post therein whereby pressure from the plunger portion will force the rubber dome upwardly within the shell thereby urging excess air within the liner to be expelled outwardly through a nipple of the baby nurser.

2 Claims, 1 Drawing Sheet

BABY NURSER WITH PLUNGER DEVICE

BACKGROUND OF THE INVENTION

1. Field of the Invention

The present invention relates to nurser bottles and more particularly pertains to a new baby nurser with plunger device for evenly expelling excess air for a nurser-style bottle.

2. Description of the Prior Art

The use of nurser bottles is known in the prior art. More specifically, nurser bottles heretofore devised and utilized are known to consist basically of familiar, expected and obvious structural configurations, notwithstanding the myriad of designs encompassed by the crowded prior art which have been developed for the fulfillment of countless objectives and requirements.

Known prior art nurser bottles include U.S. Pat. No. 3,648,873 to Grobbel; U.S. Pat. No. 4,880,125 to LeBeau; U.S. Pat. No. 5,660,359 to Lurie et al.; U.S. Pat. No. 5,524,783 to Popoff; U.S. Pat. No. Des. 331,111 to Mazza et al.; and U.S. Pat. No. 3,162,318 to Woodbury, Jr.

While these devices fulfill their respective, particular objectives and requirements, the aforementioned patents do not disclose a new baby nurser with plunger device. The inventive device includes a plunger portion that includes a circular base. The plunger portion includes a post extending upwardly from the circular base. The post has a flat upper free end. The post is dimensioned for being received within an open lower end of a shell of a baby nurser. A rubber dome is positioned within the open lower end of the shell below a liner therein. The rubber dome has an open lower end for receiving the flat upper free end of the post therein whereby pressure from the plunger portion will force the rubber dome upwardly within the shell thereby urging excess air within the liner to be expelled outwardly through a nipple of the baby nurser.

In these respects, the baby nurser with plunger device according to the present invention substantially departs from the conventional concepts and designs of the prior art, and in so doing provides an apparatus primarily developed for the purpose of evenly expelling excess air for a nurser-style bottle.

SUMMARY OF THE INVENTION

In view of the foregoing disadvantages inherent in the known types of nurser bottles now present in the prior art, the present invention provides a new baby nurser with plunger device construction wherein the same can be utilized for evenly expelling excess air for a nurser-style bottle.

The general purpose of the present invention, which will be described subsequently in greater detail, is to provide a new baby nurser with plunger device apparatus and method which has many of the advantages of the nurser bottles mentioned heretofore and many novel features that result in a new baby nurser with plunger device which is not anticipated, rendered obvious, suggested, or even implied by any of the prior art nurser bottles, either alone or in any combination thereof.

To attain this, the present invention generally comprises a baby nurser comprised of a shell having an open upper and an open lower end. The baby nurser includes a liner positioned within the shell for holding baby formula therein. The liner has an open upper end positioned within the open upper end of the shell. The baby nurser includes a nipple secured to the open upper end of the shell and is in communication with the open upper end of the liner for receiving formula therein. A plunger portion is provided that includes a circular base. The plunger portion includes a frustoconical post extending upwardly from the circular base. The post has a flat upper free end. The post is dimensioned for being received within the open lower end of the shell of the baby nurser. A rubber dome is positioned within the open lower end of the shell below the liner therein. The rubber dome has an open lower end for receiving the flat upper free end of the post therein whereby pressure from the plunger portion will force the rubber dome upwardly within the shell thereby urging excess air within the liner to be expelled outwardly through the nipple.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new baby nurser with plunger device apparatus and method which has many of the advantages of the nurser bottles mentioned heretofore and many novel features that result in a new baby nurser with plunger device which is not anticipated, rendered obvious, suggested, or even implied by any of the prior art nurser bottles, either alone or in any combination thereof.

It is another object of the present invention to provide a new baby nurser with plunger device which may be easily and efficiently manufactured and marketed.

It is a further object of the present invention to provide a new baby nurser with plunger device which is of a durable and reliable construction.

An even further object of the present invention is to provide a new baby nurser with plunger device which is susceptible of a low cost of manufacture with regard to both materials and labor, and which accordingly is then susceptible of low prices of sale to the consuming public, thereby making such baby nurser with plunger device economically available to the buying public.

Still yet another object of the present invention is to provide a new baby nurser with plunger device which provides in the apparatuses and methods of the prior art some of the advantages thereof, while simultaneously overcoming some of the disadvantages normally associated therewith.

Still another object of the present invention is to provide a new baby nurser with plunger device for evenly expelling excess air for a nurser-style bottle.

Yet another object of the present invention is to provide a new baby nurser with plunger device which includes a plunger portion that includes a circular base. The plunger portion includes a post extending upwardly from the circular base. The post has a flat upper free end. The post is dimensioned for being received within an open lower end of a shell of a baby nurser. A rubber dome is positioned within the open lower end of the shell below a liner therein. The rubber dome has an open lower end for receiving the flat upper free end of the post therein whereby pressure from the plunger portion will force the rubber dome upwardly within the shell thereby urging excess air within the liner to be expelled outwardly through a nipple of the baby nurser.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
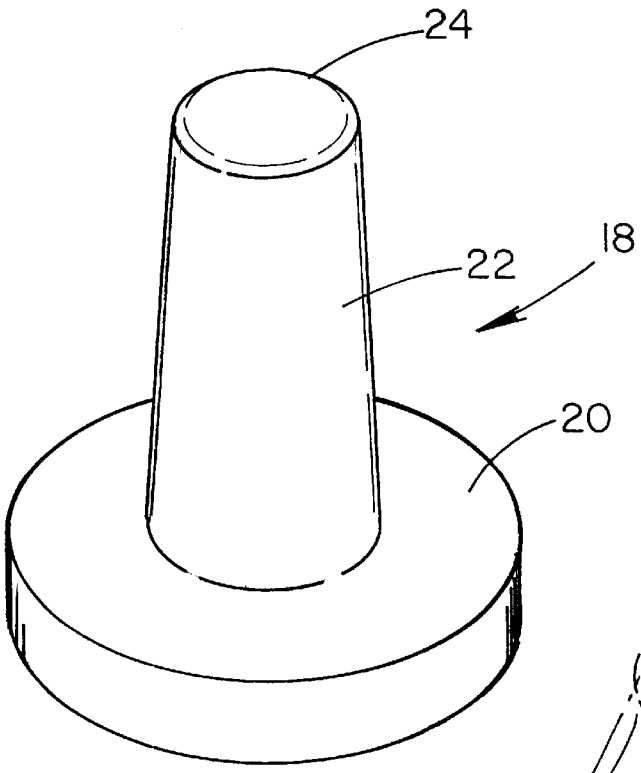
FIG. 1 is a side view of a new baby nurser with plunger device according to the present invention illustrating the plunger portion thereof.
Figure 2:
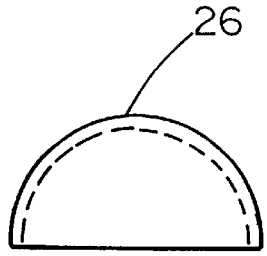
FIG. 2 is a side view of the rubber dome of the present invention.
Figure 3:
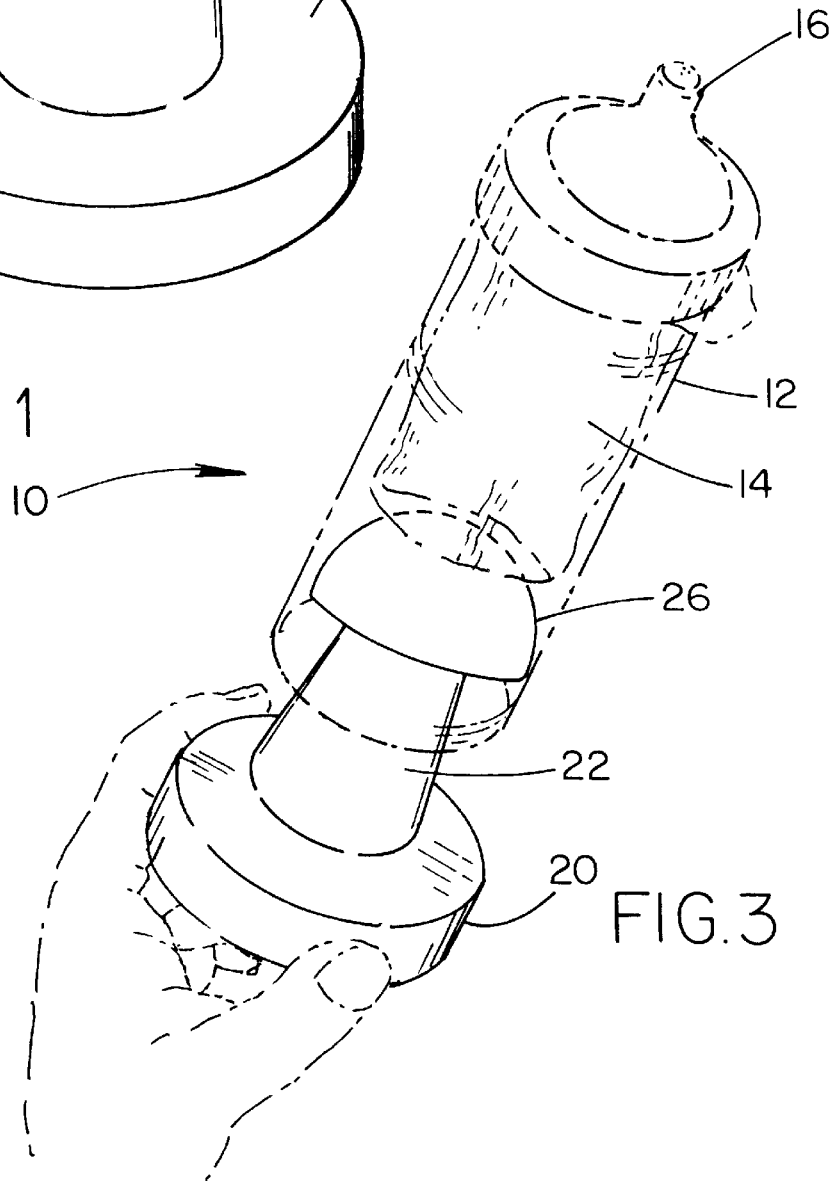
FIG. 3 is a perspective view of the present invention illustrated in use.

With reference now to the drawings, and in particular to FIGS. 1 through 3 thereof, a new baby nurser with plunger device embodying the principles and concepts of the present invention and generally designated by the reference numeral 10 will be described.

As best illustrated in FIGS. 1 through 3, the baby nurser with plunger device 10 comprises a baby nurser comprised of a shell 12 having an open upper and an open lower end. The baby nurser includes a liner 14 positioned within the shell 12 for holding baby formula therein. The liner 14 has an open upper end positioned within the open upper end of the shell 12. The baby nurser includes a nipple 16 secured to the open upper end of the shell 12 and is in communication with the open upper end of the liner 14 for receiving formula therein.

A plunger portion 18 is provided that includes a circular base 20. The plunger portion 18 includes a frustoconical post 22 extending upwardly from the circular base 20. The post 22 has a flat upper free end 24. The post 22 is dimensioned for being received within the open lower end of the shell 12 of the baby nurser.

A rubber dome 26 is positioned within the open lower end of the shell 12 below the liner 14 therein. The rubber dome 26 has an open lower end for receiving the flat upper free end 24 of the post 22 therein whereby pressure from the plunger portion 18 will force the rubber dome 26 upwardly within the shell 12 thereby urging excess air within the liner 14 to be expelled outwardly through the nipple 16.

In use, the plunger portion 18 is placed on a table and the rubber dome 26 is placed within the open lower end of the shell 12 of the baby nurser. The baby nurser is then pressed downwardly onto the plunger portion 18 whereby the excess air would be expelled from the liner 14 of the baby nurser through the nipple 16. This process could be completed with one hand, since the plunger portion 18 would rest on its circular base 20 on a table or countertop. The rubber dome 26 would remain in the shell 12 throughout the feeding and would prevent the liner 14 from refilling with air as the baby drank.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A new baby nurser with plunger device for evenly expelling excess air for a nurser-style bottle comprising, in combination:

a baby nurser comprised of a shell having an open upper and an open lower end, the baby nurser including a liner positioned within the shell for holding baby formula therein, the liner having an open upper end positioned within the open upper end of the shell, the baby nurser including a nipple secured to the open upper end of the shell and being in communication with the open upper end of the liner for receiving formula therein;

a plunger portion including a circular base, the plunger portion including a frustoconical post extending upwardly from the circular base, the post having a flat upper free end, the post being dimensioned for being received within the open lower end of the shell of the baby nurser;

a rubber dome positioned within the open lower end of the shell below the liner therein, the rubber dome having an open lower end for receiving the flat upper free end of the post therein whereby pressure from the plunger portion will force the rubber dome upwardly within the shell thereby urging excess air within the liner to be expelled outwardly through the nipple, the rubber dome member remaining within the shell abutting the liner throughout nursing to inhibit the reintroduction of air into the liner, the rubber dome frictionally engaging sides of the shell to inhibit the rubber dome from sliding away from the liner.

2. A new baby nurser with plunger device for evenly expelling excess air for a nurser-style bottle comprising, in combination:

a plunger portion including a circular base, the plunger portion including a post extending upwardly from the circular base, the post having a flat upper free end, the post being dimensioned for being received within an open lower end of a shell of a baby nurser;

a rubber dome positioned within the open lower end of the shell below a liner therein, the rubber dome having an open lower end for receiving the flat upper free end of the post therein whereby pressure from the plunger portion will force the rubber dome upwardly within the shell thereby urging excess air within the liner to be expelled outwardly through a nipple of the baby nurser, the rubber dome member remaining within the shell abutting the liner throughout nursing to inhibit the reintroduction of air into the liner, the rubber dome frictionally engaging sides of the shell to inhibit the rubber dome from sliding away from the liner.

* * * * *